US007394207B2

(12) United States Patent
Franck et al.

(10) Patent No.: US 7,394,207 B2
(45) Date of Patent: Jul. 1, 2008

(54) CIRCUIT ARRANGEMENT HAVING A FULL BRIDGE WITH SWITCHING LOAD RELIEF FOR OPERATING LAMPS

(75) Inventors: Felix Franck, München (DE); Wolfram Sowa, München (DE)

(73) Assignee: Patent-Treuhand-Gesellschaft für Glühlampen mbH, Munich (DE)

( * ) Notice: Subject to any disclaimer, the term of this patent is extended or adjusted under 35 U.S.C. 154(b) by 412 days.

(21) Appl. No.: 11/171,403

(22) Filed: Jul. 1, 2005

(65) Prior Publication Data

US 2006/0006819 A1 Jan. 12, 2006

(51) Int. Cl.
*H05B 37/02* (2006.01)
*G05F 1/00* (2006.01)

(52) U.S. Cl. ..... 315/209 R; 315/291

(58) Field of Classification Search ..... 363/17, 363/34, 37, 39, 50, 52, 55, 65, 67–68, 637–68, 363/56.01, 56.02; 315/200 R, 209, 291, 315/307, DIG. 2, 5
See application file for complete search history.

(56) References Cited

U.S. PATENT DOCUMENTS 4,864,479 A 9/1989 Steigerwald et al.
6,208,085 B1 3/2001 Lehnert et al.
6,259,213 B1 7/2001 Rudolph
6,271,633 B1 * 8/2001 Shen et al. ..... 315/209 R
6,380,694 B1 * 4/2002 Uchihashi et al. ..... 315/244
6,426,597 B2 * 7/2002 Rast et al. ..... 315/219
6,551,233 B2 * 4/2003 Perreault et al. ..... 600/9
6,683,418 B2 * 1/2004 Shoji et al. ..... 315/224
6,969,975 B2 * 11/2005 Mayer et al. ..... 323/207
7,084,584 B2 * 8/2006 Ben-Yaakov ..... 315/291

FOREIGN PATENT DOCUMENTS

EP 0 666 638 A2 8/1995

* cited by examiner

*Primary Examiner*—Douglas W. Owens
*Assistant Examiner*—Minh Dieu A
(74) *Attorney, Agent, or Firm*—Carlo S. Bessone

(57) ABSTRACT

The invention relates to a circuit arrangement for operating lamps. The circuit arrangement essentially comprises a full bridge. According to the invention, at least one inductor is connected in series with a full-bridge branch for switching load relief purposes. The circuit arrangement is preferably suitable for operation using a charge pump. PFC is thus achieved in a single-stage arrangement.

10 Claims, 5 Drawing Sheets

CIRCUIT ARRANGEMENT HAVING A FULL BRIDGE WITH SWITCHING LOAD RELIEF FOR OPERATING LAMPS

FIELD OF THE INVENTION

The invention relates to circuit arrangements for operating lamps. In the present patent application, the term lamp encompasses apparatuses which are suitable for producing electromagnetic radiation having a wavelength of between 50 nanometers and 50 000 nanometers from electrical energy. Examples of such lamps are incandescent lamps, gas discharge lamps or light-emitting diodes.

The circuit arrangement is, in particular, a full bridge, whose switches are relieved of load. Furthermore, the circuit arrangement is also suitable for keeping line current harmonics low.

BACKGROUND OF THE INVENTION

Specification U.S. Pat. No. 4,864,479 (Steigerwald) discloses a DC-to-DC converter which is in the form of a full bridge. Parasitic capacitances and diodes of the switches in the full bridge provide load relief for the switches. The switches only switch on when the voltage which is applied to the switches is zero. This is referred to in the literature as "zero voltage switching" (ZVS). The functional principle described is based on a resonant process between the parasitic capacitances and the inductive component of a load resistance. Load relief for the switches can thus only be realized in a restricted range of the operating frequency. Since lamps often need to be operated in a frequency range which is prescribed by the lamp technology, and, in addition, the inductive component of the load resistance is prescribed by inductors for current limitation purposes, switching load relief is only rarely possible in the case of full bridges from the prior art during lamp operation.

SUMMARY OF THE INVENTION

It is the object of the present invention to provide a circuit arrangement having a full bridge for operating lamps which provides switching load relief at an operating frequency which can be selected. This object is achieved by a circuit arrangement having a full bridge which is made up of a first and a second full-bridge branch, a first inductor being connected between the full-bridge branches, and a second inductor being connected in series with one of the full-bridge branches. In the present patent application, the operating frequency is understood to be the frequency of a clock at which the switches of a full-bridge branch open and close.

Owing to the circuit arrangement according to the invention, the potentials of the full-bridge branches oscillate with respect to one another such that ZVS results. This takes place at an operating frequency which can be set by the first and the second inductors and does not depend on the inductive component of the load resistance.

One advantageous development of the circuit arrangement according to the invention consists in the fact that a charge pump is supplied which brings about a reduction in the line current harmonic.

Furthermore, a phase shift in the driving of the two full-bridge branches as is described in U.S. Pat. No. 4,864,479 (Steigerwald) can also be used in a circuit arrangement according to the invention. It is thus possible with the aid of the phase shift for a desired lamp current to be set.

The invention therefore makes possible a single-stage circuit arrangement for operating a lamp having low circuit complexity, in the case of which the lamp current can be set via the above-described phase shift, and the energy balance in the charge pump can be set via the operating frequency, all of the switches provided being relieved of load.

BRIEF DESCRIPTION OF THE DRAWINGS

The invention will be explained in more detail below using exemplary embodiments with reference to drawings, in which.

In the text which follows, switches are given the letter S, diodes the letter D, capacitors the letter C, nodes the letter N and inductors the letter L, in each case followed by a number. The same references are also used throughout in the text which follows for identical and functionally identical elements of the different exemplary embodiments.

DETAILED DESCRIPTION OF THE INVENTION

Figure 1:
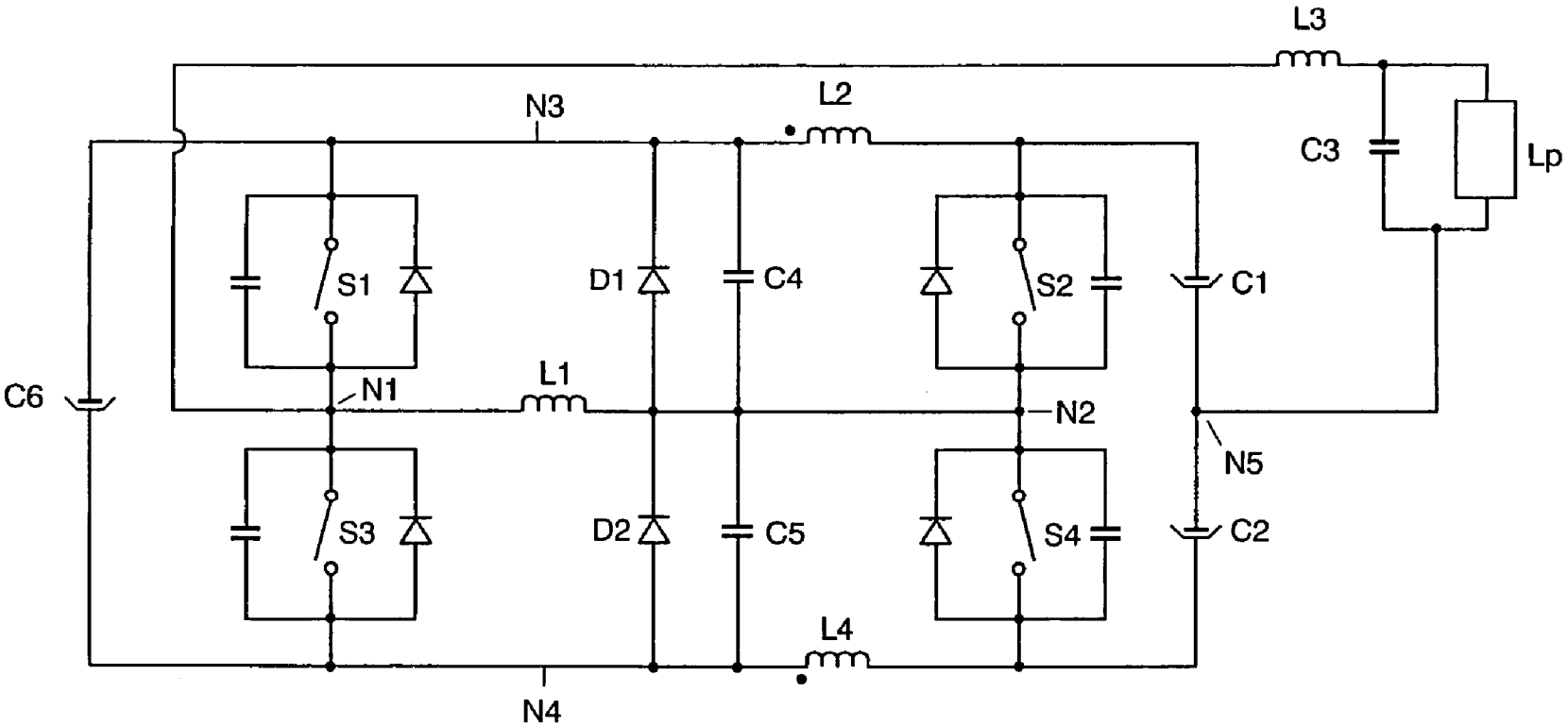
FIG. 1 shows an exemplary embodiment of a circuit arrangement according to the invention.

FIG. 1 shows a circuit arrangement according to the invention. In the text which follows, the topology of this circuit arrangement is described.

A first full-bridge branch comprises the series circuit comprising a first and a third electronic switch S1, S3 which are connected at a first center point N1. A second full-bridge branch comprises the series circuit comprising a second and a fourth electronic switch S2, S4 which are connected at a second center point N2.

The first and the second full-bridge branch are each connected with one connection to a positive node N3 and with the other connection to a negative node N4. An energy source which feeds in a DC voltage between the positive node N3 and the negative node N4 is not illustrated. A storage capacitor C6 is connected between the positive node N3 and the negative node N4.

The first and the second center points N1, N2 are connected via a first inductor L1. According to the invention, at least one second inductor L2 is connected in the second full-bridge branch in series with the second and the fourth electronic switches S2, S4.

In the exemplary embodiment, the second inductor L2 is connected between the third node N3 and the second electronic switch S2. A fourth inductor L4 is connected between the fourth node N4 and the fourth electronic switch S4. In the exemplary embodiment, the second and the fourth inductors L2, L4 are magnetically coupled. This coupling makes the currents in the switches symmetrical, which results in reduced radio interference.

The series circuit comprising a first and a second capacitor C1, C2, which are connected at a fifth node N5, is connected in parallel with the series circuit comprising the second and the fourth electronic switches S2, S4. The values for C1 and C2 are selected such that the voltage across C1 and C2 can be assumed to be constant during one cycle of the operating frequency. A connection for a load circuit is thus created at N5.

In the exemplary embodiment, the load circuit is connected between the fifth node N5 and the first center point N1. Lamps Lp can be coupled to the load circuit.

In the exemplary embodiment, the load circuit comprises a low-pass filter comprising the series circuit comprising a third inductor L3 and a third capacitor C3. A lamp Lp is connected in parallel with the third capacitor C3. The limit frequency of the low-pass filter is preferably below the operating frequency of the full bridge. A sinusoidal lamp current is thus achieved.

In order to make the circuit arrangement symmetrical, the parallel circuit comprising a fourth capacitor C4 and a first diode D1 is connected, in the exemplary embodiment, between the second and the third nodes N2, N3, and the parallel circuit comprising a fifth capacitor C5 and a second diode D2 is connected between the second and the fourth nodes N2, N4.

In each case a diode and a capacitor are connected in parallel with each electronic switch S1, S2, S3, S4. Said diode and capacitor are parasitic elements which are incorporated in the practical design of an electronic switch. The diodes are in principle not provided in the case of bipolar transistors and IGBTs, but are often integrated in the switches as freewheeling diodes. MOSFETs are often used as the electronic switches, in the case of which a so-called body diode is in principle always incorporated. According to the invention, the parasitic capacitors of the electronic switches form, together with the inductors L1, L2 and L4, a resonant circuit which brings about switching load relief.

In each full-bridge branch the electronic switches S1, S3 and S2, S4, respectively, are alternately opened and closed at a clock, the frequency of the clock being the same in each full-bridge branch. Drive devices which bring about the opening and closing of the electronic switches S1, S3, S2, S4 are not illustrated in FIG. 1. The current through the lamp can be set by means of a phase shift between the first and the second clocks.

Figure 2:
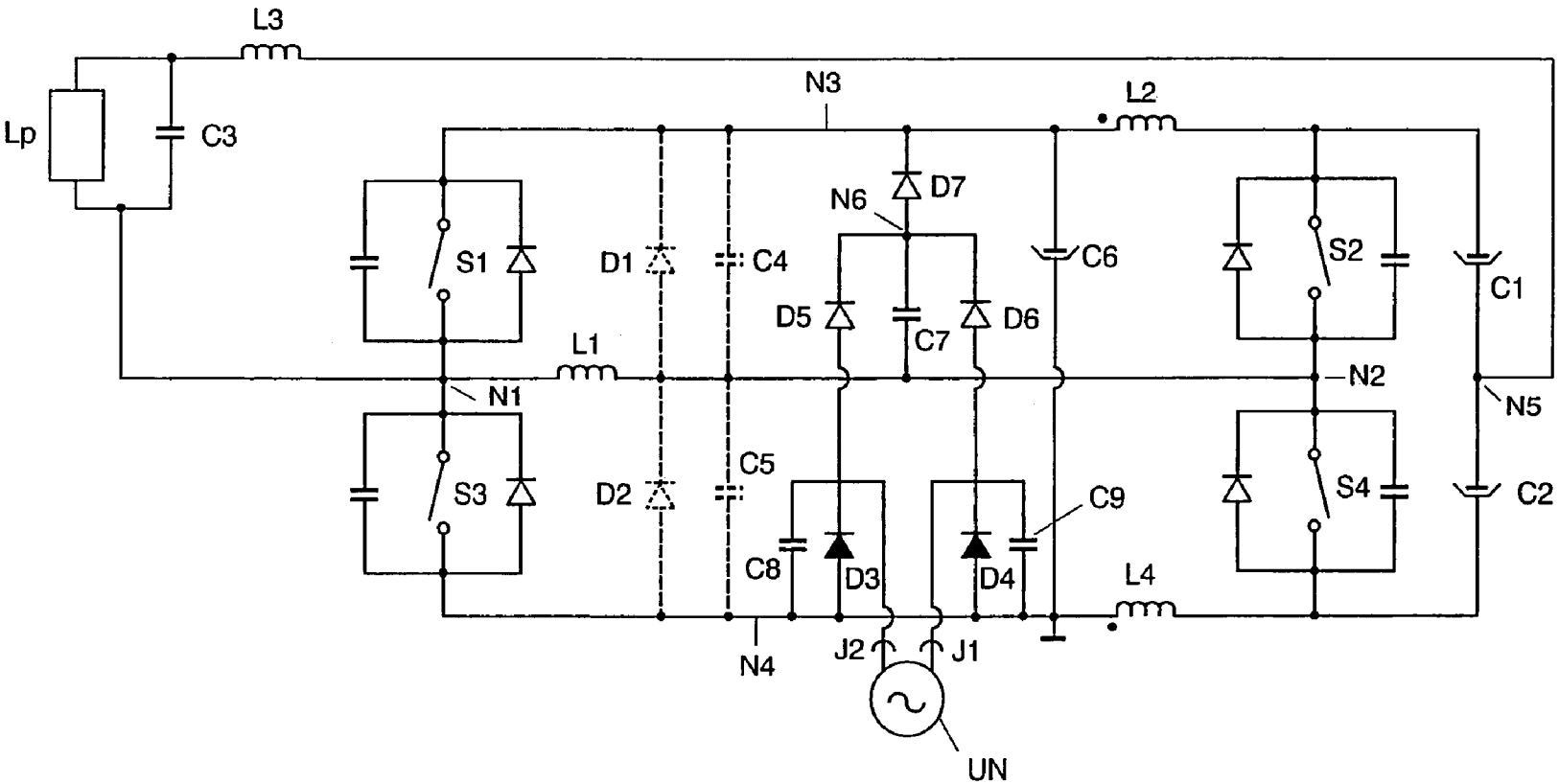
FIG. 2 shows an exemplary embodiment of a circuit arrangement according to the invention having a charge pump for the purpose of reducing the line current harmonics.

An exemplary embodiment of a circuit arrangement according to the invention having a charge pump for the purpose of reducing the line current harmonics is illustrated in FIG. 2. In FIG. 2, as an addition to FIG. 1, a pump capacitor C7 is connected between the second node N2 and a sixth node N6, and a pump diode D7 is connected between the sixth node N6 and the third node N3. The energy is now no longer fed into the positive node N3 and the negative node N4, as in the previous exemplary embodiment, but is fed into the sixth node N6 and the negative node N4. The energy originates from a system voltage source UN which is connected to system voltage connections J1, J2, J1 and J2 are connected to the AC voltage input of a bridge rectifier comprising the diodes D3, D4, D5, D6. The positive output of the bridge rectifier is connected to the sixth node N6. The negative output of the bridge rectifier is connected to the fourth node N4. The diodes D3 and D4 are colored in, whereas D5 and D6 are not. This indicates that D3 and D4 may be slow diodes which switch at the system frequency, whereas D5 and D6 must be fast diodes which operate at the operating frequency of the full bridge.

In each case a capacitor C8, C9, which is used for interference suppression purposes, is connected in parallel with D3 and D4. D1, D2 and C4, C5 are illustrated using dashed lines since they can be dispensed with.

The topology described realizes a charge pump for the purpose of reducing line current harmonics, as is known from the literature, for example from U.S. Pat. No. 6,259,213 (Rudolph). The circuit arrangement according to the invention shown in FIG. 1 may be equipped with a charge pump with very little circuitry complexity. The energy balance of the charge pump can be set with the aid of the operating frequency.

Figure 3:
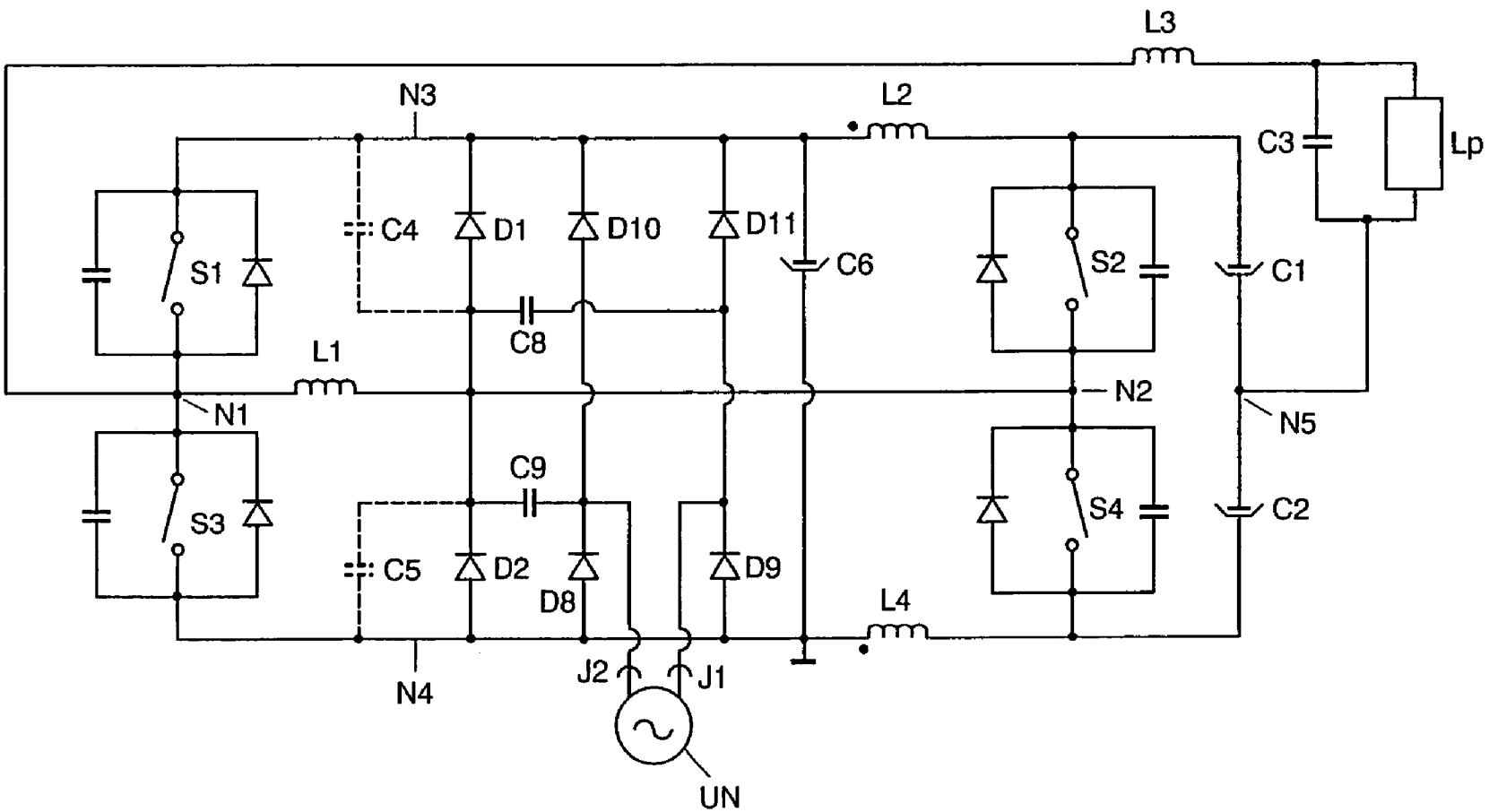
FIG. 3 shows an exemplary embodiment of a circuit arrangement according to the invention having an alternative variant of a charge pump for the purpose of reducing the line current harmonics.

In FIG. 3, a charge pump in a circuit according to the invention is realized, as is described in specification U.S. Pat. No. 6,208,085 (Lehnert). A system voltage source UN is again connected to the system voltage connections J1, J2.

The AC voltage input of a full-bridge rectifier D8, D9, D10, D11 is connected to the system voltage connections J1, J2. The positive output of the full-bridge rectifier D8, D9, D10, D11 is connected to the positive node N3, and the negative output of the full-bridge rectifier D8, D9, D10, D11 is connected to the negative node N4.

At least one system voltage connection J1, J2 is connected to the second node N2 via a capacitor C8, C9. In the exemplary embodiment, the two capacitors are provided. This is necessary in the case of lamps having a high power in order to provide sufficient pump energy. The capacitors C4 and C5 are illustrated using dashed lines in order to indicate that it is also only these which can be dispensed with, whereas D1 and D2 are provided.

Figure 4:
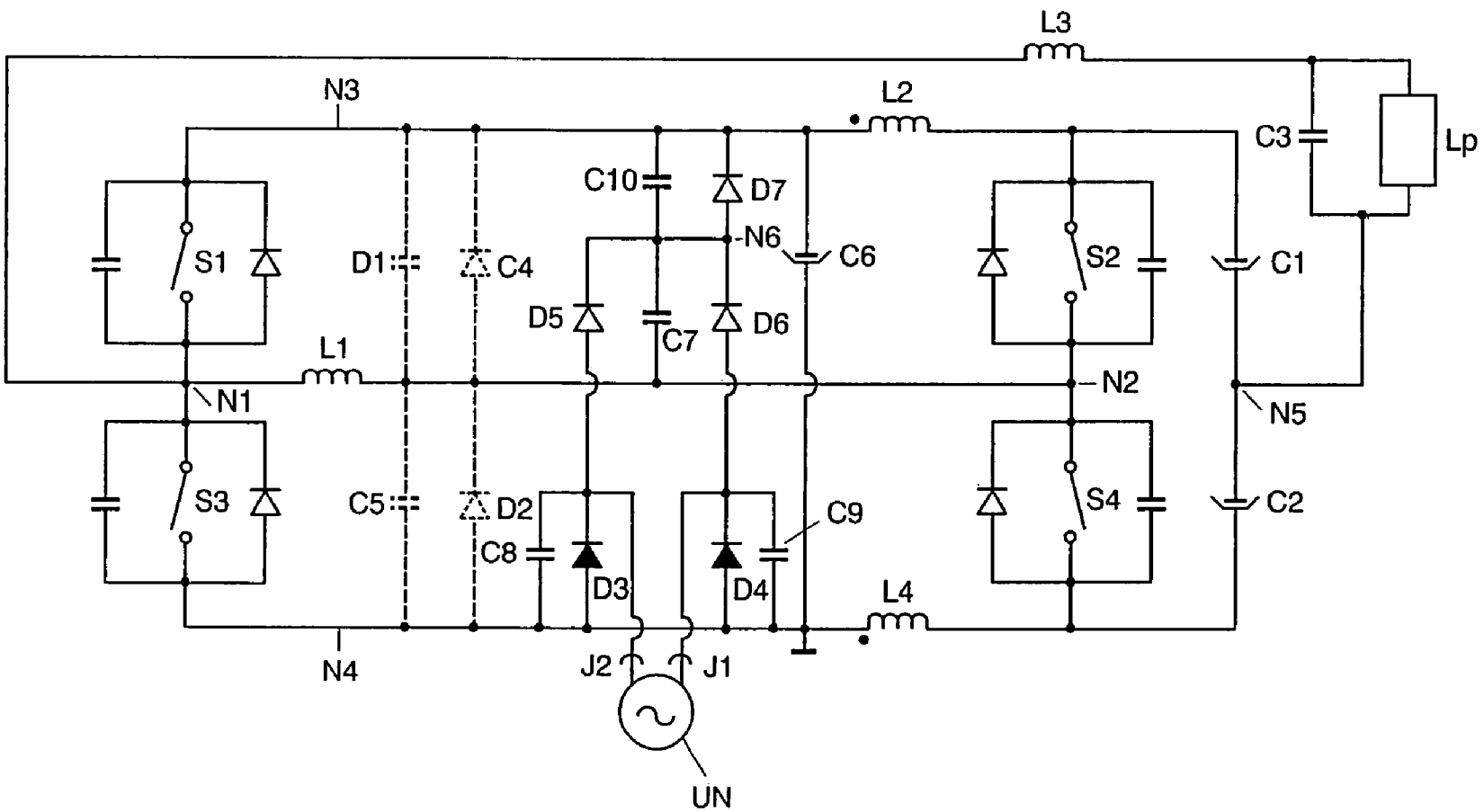
FIG. 4 shows an exemplary embodiment as shown in FIG. 2 having an additional capacitor for switching load relief purposes.

FIG. 4 differs from FIG. 2 in the parallel circuit comprising a capacitor C10 and the pump diode D7. Load relief for the electronic switches S1, S2, S3 and S4 is thus further improved.

Figure 5:
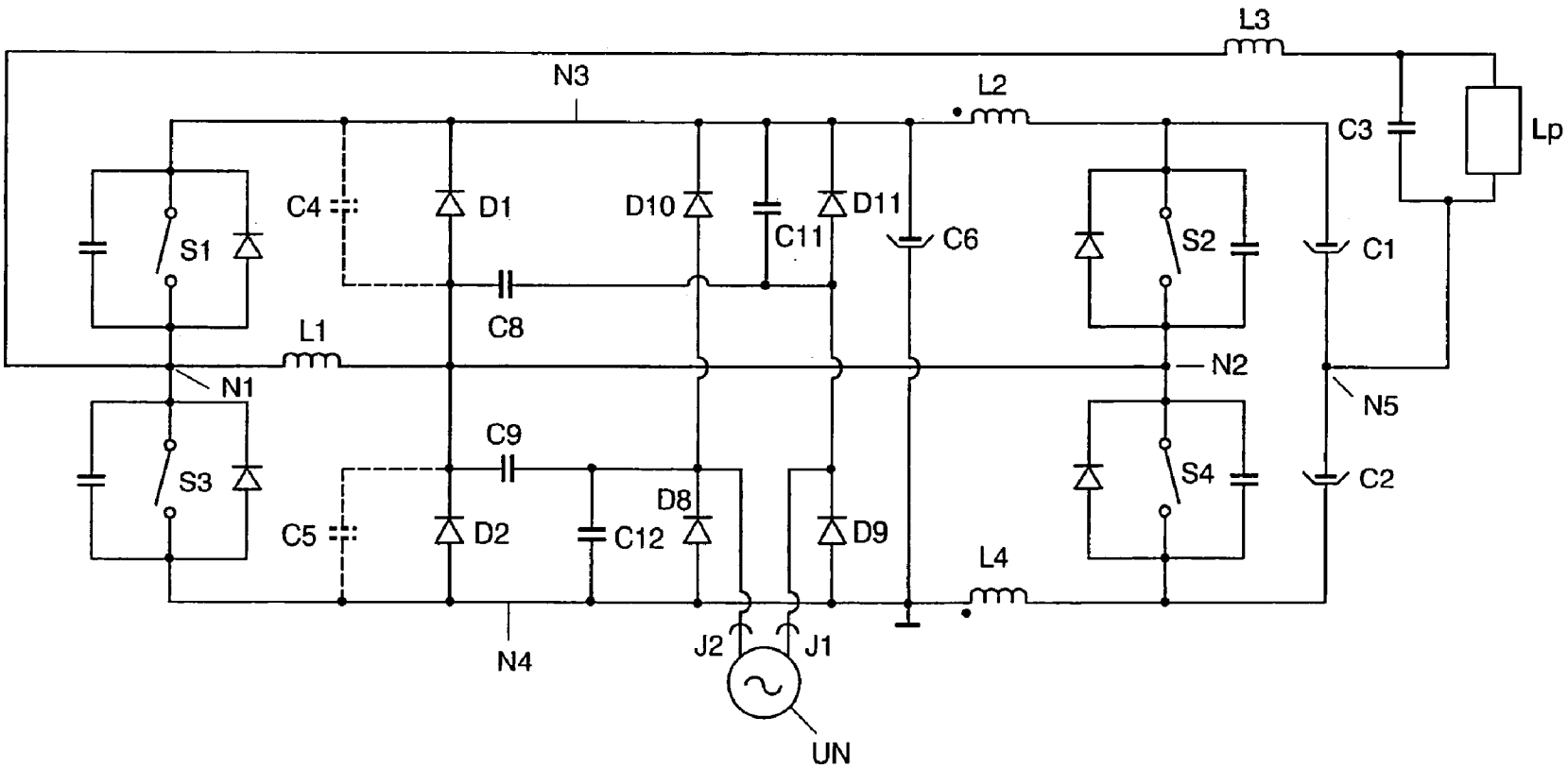
FIG. 5 shows an exemplary embodiment as shown in FIG. 3 having additional capacitors for switching load relief purposes.

FIG. 5 differs from FIG. 3 in that an eleventh capacitor C11 is connected between the first system voltage connection J1 and the third node N3, and/or in that a twelfth capacitor C12 is connected between the second system voltage connection J2 and the fourth node N4. Load relief for the electronic switches S1, S2, S3 and S4 is thus further improved. In the exemplary embodiment in FIG. 5, C11 and C12 are provided. This is necessary if it is desired to make the circuit arrangement symmetrical.

The invention claimed is:

1. A circuit arrangement for operating lamps having the following features:

a first full-bridge branch which comprises the series circuit comprising a first and a third electronic switch (S1, S3) which are connected at a first center point (N1), a second full-bridge branch which comprises the series circuit comprising a second and a fourth electronic switch (S2, S4) which are connected at a second center point (N2), the first and the second full-bridge branches are each connected with one connection to a positive node (N3) and with the other connection to a negative node (N4), a storage capacitor (C6) is connected between the positive node (N3) and the negative node (N4), and the first and the second center points (N1, N2) are connected via a first inductor (L1), characterized in that at least one second inductor (L2) is connected in the second full-bridge branch in series with the second and fourth electronic switches (S2, S4), the series circuit comprising a first and a second capacitor (C1, C2), which are connected at a fifth node (N5), is connected in parallel with the series circuit comprising the second and fourth electronic switches (S2, S4), and a load circuit, to which lamps (Lp) can be coupled, is connected between the fifth node (N5) and the first center point (N1).

2. The circuit arrangement as claimed in claim 1, characterized in that the load circuit contains a low-pass filter (L3, C3), via which lamps (Lp) can be coupled.

3. The circuit arrangement as claimed in claim 2, characterized in that the low-pass filter (L3, C3) comprises a series circuit comprising a third inductor (L3) and a third capacitor (C3).

4. A circuit arrangement for operating lamps having the following features:

a first full-bridge branch which comprises the series circuit comprising a first and a third electronic switch (S1, S3) which are connected at a first center point (N1), a second full-bridge branch which comprises the series circuit comprising a second and a fourth electronic switch (S2, S4) which are connected at a second center point (N2), the first and the second full-bridge branches are each connected with one connection to a positive node (N3) and with the other connection to a negative node (N4), a storage capacitor (C6) is connected between the positive node (N3) and the negative node (N4), and the first and the second center points (N1, N2) are connected via a first inductor (L1), characterized in that at least one second inductor (L2) is connected in the second full-bridge branch in series with the second and fourth electronic switches (S2, S4), and further characterized in that the second inductor (L2) is connected between the third node (N3) and the second electronic switch (S2), and in that a fourth inductor (L4) is connected between the fourth node (N4) and the fourth electronic switch (S4).

5. The circuit arrangement as claimed in claim 4, characterized in that the second and the fourth inductors (L2, L4) are magnetically coupled.

6. A circuit arrangement for operating lamps having the following features:

a first full-bridge branch which comprises the series circuit comprising a first and a third electronic switch (S1, S3) which are connected at a first center point (N1), a second full-bridge branch which comprises the series circuit comprising a second and a fourth electronic switch (S2, S4) which are connected at a second center point (N2), the first and the second full-bridge branches are each connected with one connection to a positive node (N3) and with the other connection to a negative node (N4), a storage capacitor (C6) is connected between the positive node (N3) and the negative node (N4), and the first and the second center points (N1, N2) are connected via a first inductor (L1), characterized in that at least one second inductor (L2) is connected in the second full-bridge branch in series with the second and fourth electronic switches (S2, S4), and further characterized in that a parallel circuit comprising a fourth capacitor (C4) and a first diode (D1) is connected between the second and the third nodes (N2, N3), and in that a parallel circuit comprising a fifth capacitor (C5) and a second diode (D2) is connected between the second and the fourth nodes (N2, N4).

7. A circuit arrangement for operating lamps having the following features:

a first full-bridge branch which comprises the series circuit comprising a first and a third electronic switch (S1, S3) which are connected at a first center point (N1), a second full-bridge branch which comprises the series circuit comprising a second and a fourth electronic switch (S2, S4) which are connected at a second center point (N2), the first and the second full-bridge branches are each connected with one connection to a positive node (N3) and with the other connection to a negative node (N4), a storage capacitor (C6) is connected between the positive node (N3) and the negative node (N4), and the first and the second center points (N1, N2) are connected via a first inductor (L1), characterized in that at least one second inductor (L2) is connected in the second full-bridge branch in series with the second and fourth electronic switches (S2, S4), and further characterized in that a pump capacitor (C7) is connected between the second node (N2) and a sixth node (N6), and a pump diode (D7) is connected between the sixth node (N6) and the third node (N3), it being possible for a rectified system voltage (UN) to be fed in between the sixth node (N6) and the fourth node (N4).

8. The circuit arrangement as claimed in claim 7, characterized in that the circuit arrangement has a full-bridge rectifier (D3, D4, D5, D6), whose positive output is connected to the sixth node (N6), and whose negative output is connected to the fourth node (N4).

9. The circuit arrangement as claimed in claim 8, characterized in that a tenth capacitor (C10) is connected between the sixth node (N6) and the third node (N3).

10. The circuit arrangement as claimed in claim 7, characterized in that a tenth capacitor (C10) is connected between the sixth node (N6) and the third node (N3).

* * * * *